US005804909A

United States Patent [19]

Nilsson et al.

[11] Patent Number: 5,804,909

[45] Date of Patent: Sep. 8, 1998

[54] EDGE EMISSION FIELD EMISSION DEVICE

[75] Inventors: Thomas Nilsson, Phoenix; John Song, Tempe; Emmett Howard, Chandler, all of Ariz.

[73] Assignee: Motorola Inc., Schaumburg, Ill.

[21] Appl. No.: 832,841

[22] Filed: Apr. 4, 1997

[51] Int. Cl.[6] ..... H01J 19/24

[52] U.S. Cl. ..... 313/309; 313/336; 313/351

[58] Field of Search ..... 313/309, 330, 313/351

[56] References Cited

U.S. PATENT DOCUMENTS 5,214,347 5/1993 Gray ..... 313/309
5,384,509 1/1995 Kane et al. ..... 313/309
5,465,024 11/1995 Kane ..... 313/309
5,466,982 11/1995 Akinwande ..... 313/309

*Primary Examiner*—Nimeshkumar Patel
*Attorney, Agent, or Firm*—Jasper W. Dockrey; Kathleen A. Tobin

[57] ABSTRACT

An edge emission FED (100) includes a supporting substrate (110); a cathode (120) disposed on the supporting substrate (110); a ballast layer (130) disposed on the cathode (120); an emissive layer (140) disposed on the ballast layer (130) and defining an emissive edge (183); a field shaper layer (150) disposed on the emissive layer (140); a dielectric layer (160) disposed on the field shaper layer (150); a gate extraction electrode (170) disposed on the dielectric layer (160); an emission well (180) defined by the ballast layer (130), the emissive edge (183), the field shaper layer (150), the dielectric layer (160), and the gate extraction electrode (170); and an anode plate (188) opposing the gate extraction electrode (170).

7 Claims, 2 Drawing Sheets

EDGE EMISSION FIELD EMISSION DEVICE

FIELD OF THE INVENTION

The present invention pertains to the area of field emission devices and, more particularly, to edge emission field emission devices.

BACKGROUND OF THE INVENTION

Field emission devices having electron emission structures generally referred to as edge emitters and surface emitters are known in the art. These devices are simpler to fabricate than field emission devices having Spindt tips.

In one prior art edge emitting field emission device, the edge emission occurs at a location between a gate extraction electrode and a collection anode. In this particular prior art scheme, after electrons are emitted from the edge emitter, the electrons are initially drawn toward the gate extraction electrode in a direction away from the collection anode. Eventually, the attractive forces from the collection anode become dominant, and the electrons are diverted away from the gate extraction electrode and travel to the collection anode. However, a portion of the electrons are not successfully diverted toward the collection anode. These electrons are energetic enough to reach the gate extraction electrode and are lost in the form of a gate leakage current. This gate leakage current reduces the efficiency of the field emission device.

In another prior art field emission device, the electron emitter includes a surface emitter. This surface emitter is disposed at the bottom of an emission well. Both the gate extraction electrode and the collection anode are positioned above the surface emitter. The gate extraction electrode is disposed above the surface emitter, and the collection anode is disposed above the gate extraction electrode. This prior art configuration provides improved electron focusing, such that gate leakage currents are reduced. However, the emissive surface is vulnerable to bombardment by contaminant ions. The emissive surfaces cover the bottom surfaces of the emission wells. Contaminant ions are generated during the fabrication of the device and during the operation of the device. A significant portion of these contaminant ions reach the bottom of these emission wells. Bombardment by contaminant ions alters and degrades the emissive properties of the emissive surface. The resulting disadvantage is reduced lifetime of the device.

Another disadvantage of prior art surface emitting devices is the low process tolerance at the emitter well forming step. The etching of the layer above the emissive layer can also etch the emissive layer. Consequently, if this etch is not appropriately controlled, the emissive layer can be etched completely at some of the emission wells. This over-etching of the emissive film produces non-uniform emission over the device.

Accordingly, there exists a need for an improved emission configuration for a field emission device that provides reduced gate leakage current, protects the emissive structure from bombardment by contaminant ions, and is simple to fabricate.

Figure 1:
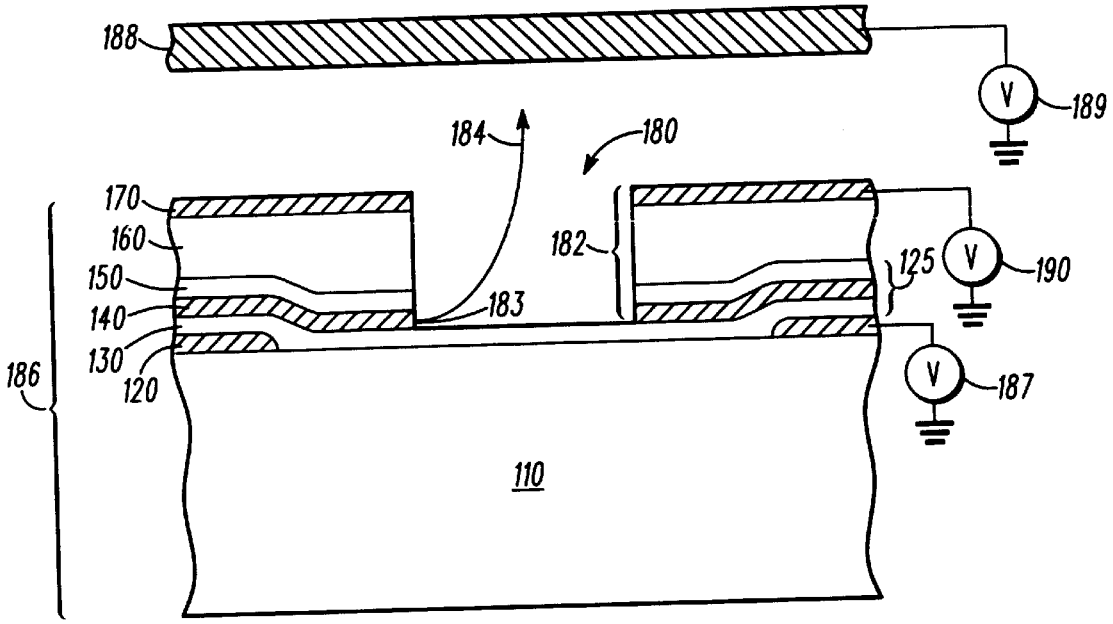
FIG. 1 is a cross-sectional view of a first embodiment of an edge emission field emission device (FED) in accordance with the invention.

It will be appreciated that for simplicity and clarity of illustration, elements shown in the FIGURES have not necessarily been drawn to scale. For example, the dimensions of some of the elements are exaggerated relative to each other. Further, where considered appropriate, reference numerals have been repeated among the FIGURES to indicate corresponding elements.

DESCRIPTION OF THE PREFERRED EMBODIMENTS

The invention is for an edge emission FED, which reduces the gate leakage current and improves the lifetime of the device. A field emission device in accordance with the invention has an emission configuration that protects the edge emissive surface from ion bombardment. It further improves electron focusing, such that fewer emitted electrons are lost at the gate extraction electrode. The invention also reduces the amount of exposed dielectric surface area within the device that would otherwise become charged and adversely deflect the electrons during the operation of the device.

FIG. 1 illustrates, in cross-section, an edge emission FED 100 in accordance with the invention. Edge emission FED 100 includes a cathode plate 186 and an opposing anode plate 188. Cathode plate 186 includes a supporting substrate 110, which is made from a hard dielectric material, such as silicon, glass, and the like. A cathode 120 is formed on supporting substrate 110. Cathode 120 includes a layer of a conductive material, such as aluminum, molybdenum, and the like. Cathode 120 is formed using a convenient deposition technique. Cathode 120 is patterned to define gaps above which emission wells are formed, as is described in greater detail below.

Edge emission FED 100 further includes an emissive structure 125, which is disposed on cathode 120. In general, emissive structure 125 includes at least one layer of an emissive material, such as diamond-like carbon, diamond, partially graphitized nanocrystalline carbon, and the like, which defines at least one emissive edge. In general, the emissive material includes a material having low electric field electron emissive properties. Emissive structure 125 may further include one or more resistive layers. In the preferred embodiment, emissive structure 125, includes a ballast layer 130, an emissive layer 140, and a field shaper layer 150.

Ballast layer 130 includes a layer of a resistive material that is formed on cathode 120. In the preferred embodiment ballast layer 130 is made from a phosphorous-doped, amorphous silicon. The sheet resistance of ballast layer 130 is about $1\times10^7$ ohm·cm.

Emissive layer 140 includes a layer of an electron emissive material, such as diamond-like carbon, diamond, partially graphitized nanocrystalline carbon, and the like. In general, emissive layer 140 includes a low electric field electron emissive film, which yields greater than about 1 nanoamp of current at field strengths less than 200 V/$\mu$m. Emissive layer 140 is disposed on ballast layer 130. Emissive layer 140 is formed by a deposition technique, such as vacuum arc deposition, plasma enhanced chemical vapor deposition, other forms of chemical vapor deposition, spin-on techniques, various growth techniques, and the like. In the embodiment of FIG. 1, the resistance of emissive layer 140 is greater than the resistance of ballast layer 130.

Field shaper layer 150 is formed on emissive layer 140 and includes a layer of a resistive material. In the preferred embodiment field shaper layer 150 is made from amorphous silicon.

Subsequent to the formation of emissive structure 125, a dielectric layer 160 is formed on emissive structure 125. Dielectric layer 160 includes a layer of a dielectric material, such as silicon dioxide, silicon nitride, and the like. Dielectric layer 160 is deposited by a convenient deposition technique.

Following the formation of dielectric layer 160, a gate extraction electrode 170 is formed on dielectric layer 160. Gate extraction electrode 170 includes a layer of a conductive material, such as molybdenum, aluminum, and the like, which is deposited by a convenient deposition method.

After the deposition of gate extraction electrode 170, an emission well 180 is formed by selectively etching through gate extraction electrode 170, dielectric layer 160, field shaper layer 150, and emissive layer 140. Emission well 180 overlies the gap in cathode 120. Ballast layer 130 is not completely etched through to supporting substrate 110.

A wall 182 of emission well 180 is defined by gate extraction electrode 170, dielectric layer 160, field shaper layer 150, and emissive layer 140. That portion of wall 182 defined by emissive layer 140 includes an emissive edge 183, from which electrons are extractable. In contrast to the prior art, the present invention allows greater process tolerance at the step of etching the emission well, because an emissive edge, rather than an emissive surface, is formed at the bottom of the emission well. In this manner tight control of the process to prevent etching through the emissive layer is not required.

The portion of ballast layer 130 between cathode 120 and emissive edge 183 provides a lateral ballast resistance therebetween. The incorporation of ballasting resistors in an array of edge electron emitters allows uniform current distribution throughout the array. The portion of ballast layer 130 at the bottom of emission well 180 conducts impinging charges, such that the bottom surface does not become charged.

Edge emission FED 100 further includes anode plate 188, which is spaced from gate extraction electrode 170. Anode plate 188 includes a layer of conductive material or highly resistive material, such as aluminum, indium tin oxide, and the like, for collecting electrons.

As an example, and in no way intended to limit the scope of the invention, the thicknesses of the layers of edge emission FED 100 may be: 2000 angstroms for each of cathode 120, ballast layer 130, and field shaper layer 150; within a range of 2000–3000 angstroms for gate extraction electrode 170; 1 micron for dielectric layer 160; and 1000 angstroms for emissive layer 140. The diameter and depth of emission well 180 are be about 4 microns and 1 micron, respectively.

The operation of edge emission FED 100 includes connecting cathode 120 to a first potential source 187, connecting gate extraction electrode 170 to a second potential source 190, and connecting anode plate 188 to a third potential source 189. To extract electrons from emissive edge 183 and collect them at anode plate 188, gate extraction electrode 170 is held at a potential that is higher than that of cathode 120, and anode plate 188 is held at a potential that is higher than that of gate extraction electrode 170. An example potential configuration includes ground potential at cathode 120, about 50 volts at gate extraction electrode 170, and about 5000 volts at anode plate 188. Electrons, which are indicated by an arrow 184 in FIG. 1, are emitted from emissive edge 183, traverse through emission well 180, and are received by anode plate 188.

Because emissive edge 183 is separated from gate extraction electrode 170 by dielectric layer 160, and because the emitted electrons are initially directed generally toward anode plate 188, fewer electrons are lost at gate extraction electrode 170. As the electrons traverse emission well 180, the attractive forces from anode plate 188 direct the electrons away from gate extraction electrode 170 and focus them toward anode plate 188.

Another advantage of the present configuration is that emissive edge 183 is disposed along wall 182 of emission well 180. Fewer contaminant ions impinge upon a unit area of wall 182 than upon the same area at the bottom surface of emission well 180. Thus, fewer contaminant ions per unit area impinge upon emissive edge 183 than upon prior art emissive surfaces that are disposed at the bottom of an emission well. By reducing the ionic bombardment, the lifetime of the device is increased.

A further advantage of the invention is that the total dielectric surface area is not increased over that of prior art devices. Dielectric surfaces within the device have a tendency to become positively charged during the operation of the device. This is due to the impingement of cations upon the dielectric surfaces. The positively charged dielectric surfaces are undesirable because they deflect the electron beams. In the preferred embodiment, emission well 180 is defined, at the bottom, by ballast layer 130, rather than by supporting substrate 110. Ballast layer 130 is capable of bleeding off the positive charge.

Figure 2:
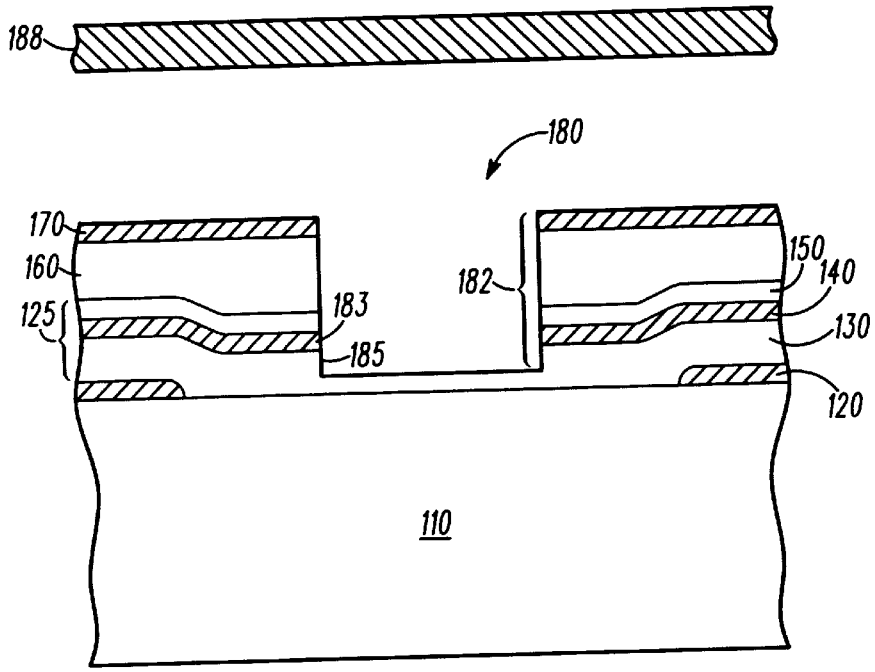
FIG. 2 is a cross-sectional view of a second embodiment of an edge emission FED in accordance with the invention.

FIG. 2 illustrates, in cross-section, an edge emission FED 200 in accordance with the invention. In the embodiment of FIG. 2, emissive edge 183 is spaced from the bottom surface of emission well 180. To provide this spaced relationship, ballast layer 130 is partially etched to form a wall portion 185, which partially defines wall 182 of emission well 180.

The electric field within emission well 180 varies along the height thereof. Thus, the characteristics of the electric field at emissive edge 183 can be controlled by adjusting the vertical position of emissive edge 183 along wall 182. This configuration, wherein emissive edge 183 is vertically displaced from the bottom of emission well 180, may also reduce the extent of ion bombardment at emissive edge 183.

Figure 3:
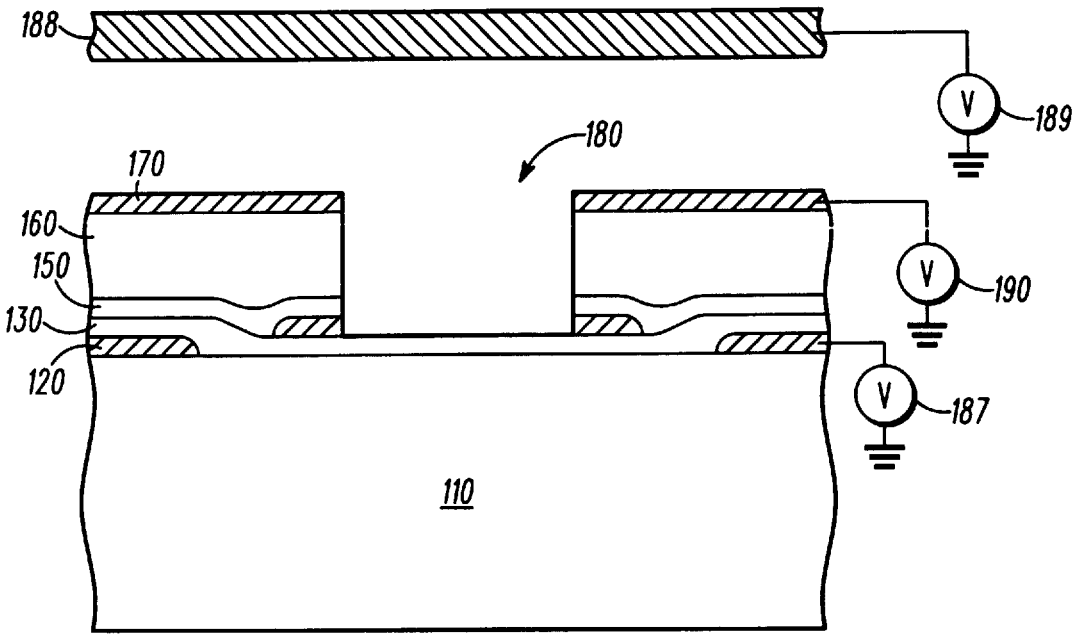
FIG. 3 is a cross-sectional view of a third embodiment of an edge emission FED in accordance with the invention.

FIG. 3 illustrates, in cross-section, an edge emission FED 300 in accordance with the invention. In the embodiment of FIG. 3, the resistance of emissive layer 140 is less than the resistance of ballast layer 130, and a lateral gap is provided between cathode 120 and emissive layer 140.

Figure 4:
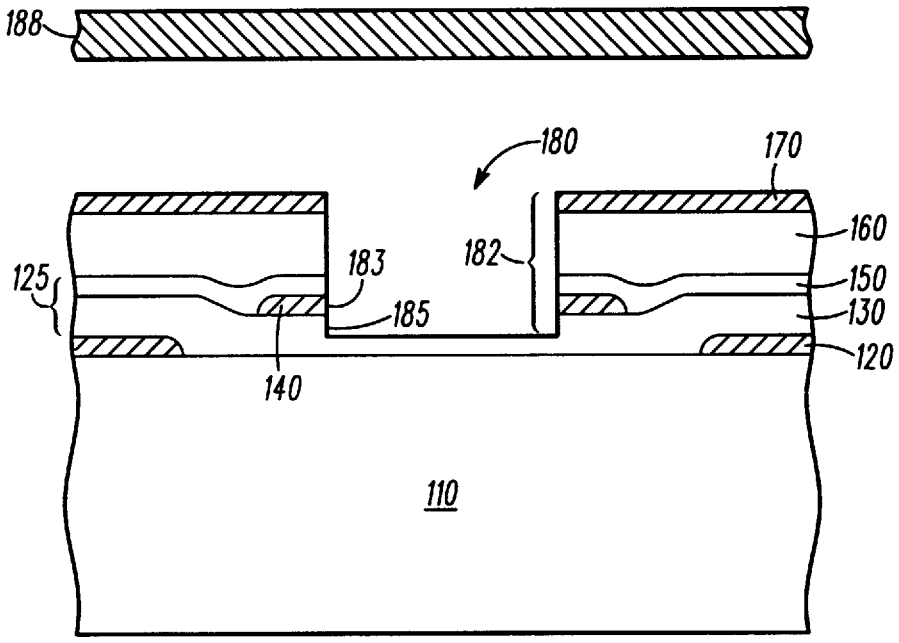
FIG. 4 is a cross-sectional view of a fourth embodiment of an edge emission FED in accordance with the invention.

FIG. 4 illustrates, in cross-section, an edge emission FED 400 in accordance with the invention. Edge emission FED 400 includes a lateral gap between cathode 120 and emissive layer 140, such as described with reference to FIG. 3. In the embodiment of FIG. 4, emissive edge 183 is spaced from the bottom surface of emission well 180 in the manner described with reference to FIG. 2.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

We claim:

1. An edge emission FED comprising:

a supporting substrate having a major surface;

an emissive structure disposed on the major surface of the supporting substrate and defining an emissive edge;

a dielectric layer disposed on the emissive structure;

a gate extraction electrode disposed on the dielectric layer;

the emissive edge, the dielectric layer, and the ballast layer defining an emission well, wherein the gate extraction electrode is proximate to the emission well;

an anode plate opposing the gate extraction electrode, wherein the emissive structure includes a ballast layer disposed on the supporting substrate and defines a bottom surface of the emission well.

2. The edge emission FED of claim 1, wherein the emissive edge is vertically spaced from the bottom surface of the emission well.

3. An edge emission FED comprising:

a supporting substrate having a major surface;

a cathode disposed on the major surface of the supporting substrate;

an emissive structure disposed on the cathode and defining an emissive edge;

a dielectric layer disposed on the emissive structure;

a gate extraction electrode disposed on the dielectric layer;

an emission well defined by the emissive structure, the dielectric layer, and the gate extraction electrode;

an anode plate having a major surface opposing the gate extraction electrode, wherein the emissive structure includes a ballast layer disposed on the supporting substrate and defines a bottom surface of the emission well.

4. The edge emission FED of claim 3, wherein the emissive edge is vertically spaced from the bottom surface of the emission well.

5. An edge emission FED comprising:

a supporting substrate having a major surface;

a cathode disposed on the major surface of the supporting substrate;

a ballast layer disposed on the cathode;

an emissive layer disposed on the ballast layer and defining an emissive edge;

a field shaper layer disposed on the emissive layer;

a dielectric layer disposed on the field shaper layer;

a gate extraction electrode disposed on the dielectric layer;

an emission well defined by the ballast layer, the emissive edge, the field shaper layer, the dielectric layer, and the gate extraction electrode; and an anode plate having a major surface opposing the gate extraction electrode.

6. The edge emission FED of claim 5, wherein the emissive layer is laterally spaced from the cathode.

7. The edge emission FED of claim 5, wherein the ballast layer, the emissive edge, the field shaper layer, and the dielectric layer define a wall of the emission well.

* * * * *